US010863262B2

(12) United States Patent
Hoang Co Thuy

(10) Patent No.: US 10,863,262 B2
(45) Date of Patent: Dec. 8, 2020

(54) DEVICE FOR CONTROLLING A LOUDSPEAKER AND ASSOCIATED SOUND REPRODUCTION FACILITY

(71) Applicant: DEVIALET, Paris (FR)

(72) Inventor: Vu Hoang Co Thuy, Paris (FR)

(73) Assignee: DEVIALET, Paris (FR)

( * ) Notice: Subject to any disclaimer, the term of this patent is extended or adjusted under 35 U.S.C. 154(b) by 0 days.

(21) Appl. No.: 16/594,921

(22) Filed: Oct. 7, 2019

(65) Prior Publication Data

US 2020/0112784 A1 Apr. 9, 2020

(30) Foreign Application Priority Data

Oct. 8, 2018 (FR) ..... 18 59277

(51) Int. Cl.
*H04R 1/28* (2006.01)
*H04R 9/06* (2006.01)

(52) U.S. Cl.
CPC ..... *H04R 1/2803* (2013.01); *H04R 1/283* (2013.01); *H04R 9/06* (2013.01)

(58) Field of Classification Search
CPC ..... H04R 29/001; H04R 3/007
(Continued)

(56) References Cited

U.S. PATENT DOCUMENTS

2005/0123162 A1* 6/2005 Huffman ..... H04R 1/2826 381/337
2009/0268918 A1 10/2009 Solgaard et al.
(Continued)

FOREIGN PATENT DOCUMENTS

WO WO-2018/157417 7/2018

OTHER PUBLICATIONS

Preliminary Search Report dated Jun. 11, 2019 French Application No. FR 1859277.

*Primary Examiner* — Alexander Krzystan
(74) *Attorney, Agent, or Firm* — B. Aaron Schulman, Esq.; Stites & Harbison, PLLC

(57) ABSTRACT

The present invention relates to a device (22) for controlling a loudspeaker in an enclosure, the device (22) comprising:

a unit (36) for duplicating a desired dynamic signal ($S_{dyn}$) to obtain two identical desired dynamic signals ($S_{dyn1}$, $S_{dyn2}$), a first processing unit (38) configured to process the first desired dynamic signal ($S_{dyn1}$) to obtain a first processed signal ($S_{dyn1}'$) whereof the frequencies are less than or equal to a predetermined frequency, a second processing unit (40) configured to process the second desired dynamic signal ($S_{dyn2}$) to obtain a second processed signal ($S_{dyn2}'$) whereof the frequencies are strictly greater than the predetermined frequency, and a unit (42) for combining the processed first and second signals ($S_{dyn1}'$, $S_{dyn2}'$) to obtain a control signal ($S_{commande}$) of the loudspeaker.

10 Claims, 3 Drawing Sheets

(58) Field of Classification Search
USPC ..... 381/55, 59, 94.3
See application file for complete search history.

(56) References Cited

U.S. PATENT DOCUMENTS

| | | | | |
|---|---|---|---|---|
| 2016/0173983 | A1 | 6/2016 | Berthelsen et al. | |
| 2018/0014121 | A1* | 1/2018 | Lawrence | H04R 3/007 |
| 2018/0192229 | A1* | 7/2018 | Easley | H04R 3/14 |

* cited by examiner

DEVICE FOR CONTROLLING A LOUDSPEAKER AND ASSOCIATED SOUND REPRODUCTION FACILITY

CROSS-REFERENCE

This claims the benefit of French Patent Application FR 18 59277, filed Oct. 8, 2018 and hereby incorporated by reference herein.

FIELD OF THE INVENTION

The present invention relates to a device for controlling a loudspeaker in an enclosure. The present invention also relates to a sound reproduction facility comprising such a control device.

BACKGROUND OF THE INVENTION

Loudspeakers are electromagnetic devices that convert an electrical signal into an acoustic signal.

Loudspeakers introduce a nonlinear distortion that may affect the obtained acoustic signal considerably. The distortion comes from different factors, in particular the nonlinearity of the magnetic circuit of the loudspeaker and certain mechanical elements of the loudspeaker.

Furthermore, the current circulating in a loudspeaker can bring the temperature of the conductors of the loudspeaker to a value that may damage them. Additionally, even without leading to the deterioration of the conductors, the increased temperature of the conductors causes an increase in their ohmic resistance. This causes a phenomenon, called "thermal compression", which consists in a decrease of the efficiency of the loudspeaker with the increase of the resistance.

Lastly, excessive movements of the diaphragm of the loudspeaker following an inappropriate supply can damage the membrane of the loudspeaker.

Solutions have been proposed to control loudspeakers to eliminate the distortions in the behavior of the loudspeaker through an appropriate command.

However, such solutions can be further improved.

SUMMARY OF THE INVENTION

There is therefore a need for a device for controlling a loudspeaker in an enclosure making it possible to reduce the distortion in the signal reproduced by the loudspeaker while improving the protection of the diaphragm of the loudspeaker.

To that end, the invention relates to a device for controlling a loudspeaker in an enclosure, the loudspeaker comprising a diaphragm, the enclosure having a structure, the device comprising:

- an input for an audio signal to be reproduced,
- an output for supplying a control signal of the loudspeaker,
- a unit for determining a desired dynamic signal, representative of a desired dynamic property of the diaphragm of the loudspeaker, as a function of the audio signal to be reproduced and the structure of the enclosure,
- a unit for duplicating the desired dynamic signal to obtain two identical desired dynamic signals,
- a first processing unit configured to process the first desired dynamic signal to obtain a first processed signal whereof the frequencies are less than or equal to a predetermined frequency,

- a second processing unit configured to process the second desired dynamic signal to obtain a second processed signal whereof the frequencies are strictly greater than the predetermined frequency, and
- a unit for combining the processed first and second signals to obtain the control signal of the loudspeaker.

According to specific embodiments, the control device includes one or more of the following features, considered alone or according to any technically possible combinations:

- the first processing unit comprises an excursion limiter configured to:
  - determine an excursion signal, representative of the excursion of the diaphragm of the loudspeaker, as a function of the desired first dynamic signal,
  - determine the maximum excursion of the excursion signal, and
  - when the determined maximum excursion is strictly greater than an acceptable maximum excursion, apply a first attenuation gain to the excursion signal to obtain an attenuated excursion signal,
    the first processed signal being obtained as a function of the attenuated excursion signal.
- the loudspeaker comprises at least one coil, the first processing unit comprising:
  - a module for filtering frequencies of the attenuated excursion signal strictly higher than the predetermined frequency to obtain a filtered excursion signal,
  - a module for determining a first intensity signal, representative of the intensity of the current suitable for circulating in the coil of the loudspeaker, as a function of the filtered excursion signal and an electromechanical model of the loudspeaker, and
  - a current limiter configured to set at a predetermined intensity value, all of the values of the first intensity signal strictly higher than the predetermined intensity value and thus to obtain an attenuated first intensity signal,
    the first processed signal being obtained as a function of the attenuated first intensity signal.
- the first processing unit comprises:
  - a module for determining a first voltage signal, representative of the voltage across the terminals of the loudspeaker, as a function of the filtered excursion signal, the electromechanical model of the loudspeaker and the attenuated first intensity signal, and
  - a voltage limiter configured to set at a predetermined voltage value, all of the values of the first voltage signal strictly higher than the predetermined voltage value and thus to obtain an attenuated first voltage signal,
    the first processed signal being obtained as a function of the attenuated first voltage signal.
- the first processing unit comprises an additional filtering module configured to filter the frequencies of the attenuated first voltage signal strictly higher than the predetermined frequency, the processed first signal being obtained as a function of the attenuated first voltage signal filtered by the additional filtering module.
- the second processing unit comprises:
  - a module for filtering frequencies of the second desired dynamic signal lower than or equal to the predetermined frequency in order to obtain a second filtered signal,
  - a module for determining a second voltage signal, representative of the voltage across the terminals of the loudspeaker, as a function of the second filtered signal and an electromechanical model of the loudspeaker, the second processed signal being obtained as a function of the second voltage signal.

the second processing unit comprises a voltage limiter configured to:

determining the maximum voltage of the second voltage signal, when the determined maximum voltage is strictly greater than an acceptable maximum voltage, apply a second attenuation gain to the second voltage signal to obtain a second attenuated voltage signal, the second processed signal being obtained as a function of the second attenuated voltage signal.

the second processing unit comprises an additional filtering module configured to filter the frequencies of the attenuated second voltage signal less than or equal to the predetermined frequency, the processed second signal being obtained as a function of the attenuated second voltage signal filtered by the additional filtering module.

the predetermined frequency is comprised in a frequency interval centered on the resonance frequency of the loudspeaker and extending over no more than 200 Hz.

The present invention also relates to a sound reproduction facility comprising a loudspeaker in an enclosure and a device for controlling the loudspeaker as previously described.

BRIEF DESCRIPTION OF THE DRAWINGS

The invention will be better understood upon reading the following description, provided solely as an example and in reference to the drawings, in which.

DETAILED DESCRIPTION OF THE INVENTION

Figure 1:
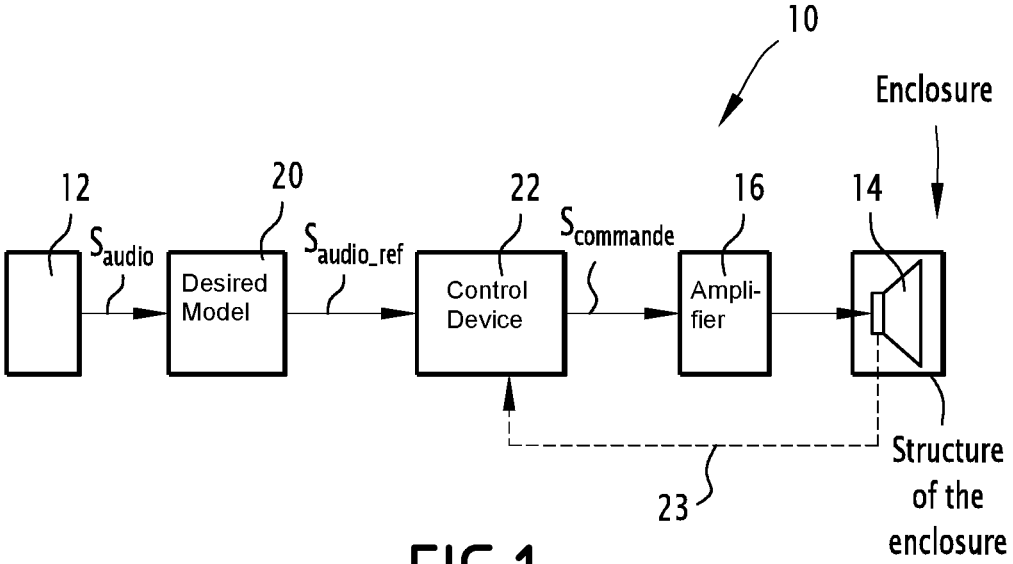
FIG. 1 is a schematic view of a sound reproduction facility comprising a loudspeaker in an enclosure and a device for controlling the loudspeaker.

A sound reproduction facility 10 is illustrated by FIG. 1.

The facility 10 includes, as is known in itself, a source 12 for producing an audio signal $S_{audio}$, such as a digital disc reader connected to a loudspeaker 14 in an enclosure, through a voltage amplifier 16. Between the audio source 12 and the amplifier 16, a desired model 20, corresponding to the desired behavior model of the enclosure, and a control device 22 are arranged, successively in series. The desired model 20 is a linear model or a nonlinear model.

According to one particular embodiment, a loop 23 for measuring a physical value, such as the temperature of the magnetic circuit of the loudspeaker 14 or the intensity circulating in the coil of the loudspeaker 14, is provided between the loudspeaker 14 and the control device 22.

The desired model 20 is independent of the loudspeaker 14 used in the facility and the model of the loudspeaker 14.

The desired model 20 is, for example, a function of the ratio of the amplitude of the desired signal, denoted $S_{audio_ref}$, to the amplitude $S_{audio}$ of the input signal of the source 12, expressed as a function of the frequency.

Advantageously, for frequencies below a frequency $f_{min}$, such a ratio is a function converging toward 0 when the frequency tends towards 0. This makes it possible to limit the reproduction of excessively low frequencies, and thus to avoid movements of the diaphragm of the loudspeaker 14 outside ranges recommended by the manufacturer.

The same is true for high frequencies, where the ratio tends towards 0 beyond a frequency $f_{max}$ when the frequency of the signal tends toward infinity.

According to another embodiment, the desired model is not specified and the desired model is considered to be unitary.

Figure 2:
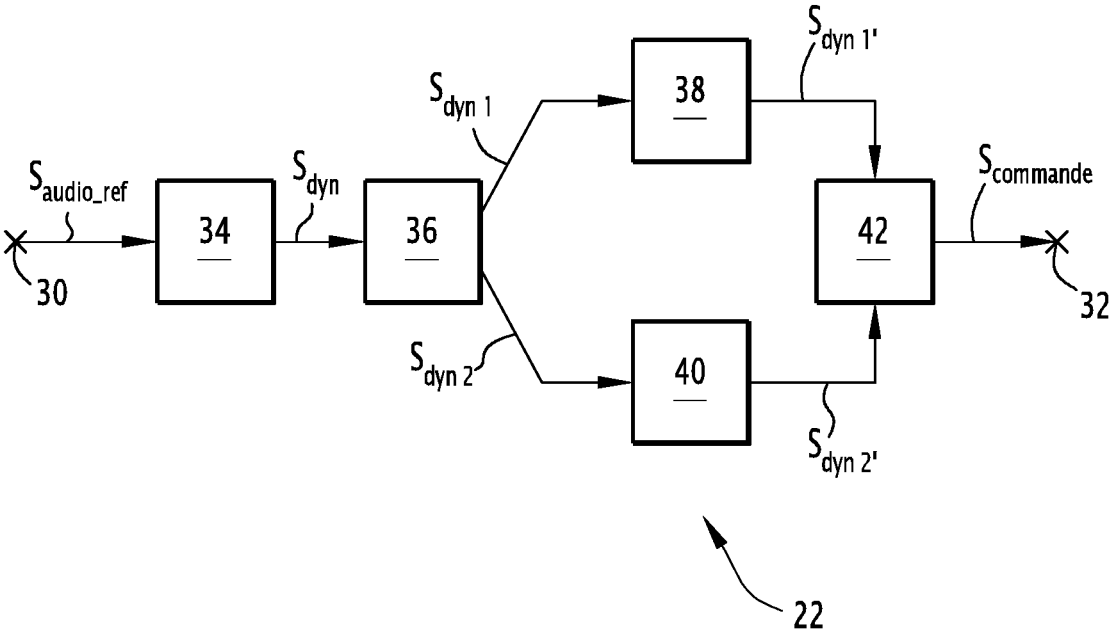
FIG. 2 is a schematic view of the control device of FIG. 1.

The control device 22, an example of the detailed structure of which is illustrated by FIG. 2, is arranged at the input of the amplifier 16.

The control device 22 is able to receive, as input, the audio signal $S_{audio_ref}$ to be reproduced as defined at the output of the desired model 20 and to provide, as output, a control signal $S_{commande}$ of the loudspeaker 14, also called excitation signal. In one preferred embodiment, the loudspeaker 14 is controlled in terms of voltage and the control signal $S_{commande}$ is a voltage.

As will be described in the remainder of the description, the control signal $S_{commande}$ is suitable for taking account of the nonlinearity of the loudspeaker 14 and limiting the excessive movements of the diaphragm of the loudspeaker 14. In general, the control device 22 uses the Thiele and Small model of the loudspeaker 14, in order to obtain a target frequency response (for example, flat).

In the example illustrated by FIG. 2, the control device 22 comprises an input 30 for the signal $S_{audio_ref}$ to be reproduced and an output 32 for supplying the control signal $S_{commande}$ of the loudspeaker 14. The control device 22 also comprises a unit 34 for determining a desired dynamic signal $S_{dyn}$, a unit 36 for duplicating the desired dynamic signal $S_{dyn}$, a first processing unit 38, a second processing unit 40 and a combining unit 42.

The determining unit 34 is configured to determine, at each moment, the desired dynamic signal $S_{dyn}$, representative of a desired dynamic property $A_{ref}$ of the diaphragm of the loudspeaker 14, as a function of the audio signal $S_{audio_ref}$ to be reproduced and the structure of the enclosure. The structure of the enclosure is defined as a function of the characteristics of the considered type of enclosure (dimensions, electromechanical parameters). For example, a first type of enclosure is an enclosed enclosure (closed enclosure). A second type of enclosure is a vented enclosure. A third type of enclosure is an enclosure comprising a second passive loudspeaker having a resonator function.

To that end, the determining unit 34 is capable of applying a unit conversion gain, depending on the peak voltage of the amplifier 16 at the output of the control device 22 and an attenuation varying between 0 and 1 controlled by the user. This ensures the passage from the audio signal to be reproduced $S_{audio_ref}$ to a signal $\gamma_0$, image of a physical property to be reproduced. The signal $\gamma_0$, is, for example, an acceleration of the air opposite the loudspeaker 14 or a speed of the air to be moved by the loudspeaker 14.

The determining unit 34 is capable of determining the desired dynamic signal $S_{dyn}$, representative of the desired dynamic property $A_{ref}$, at each moment, as a function of a corresponding property, here the signal $\gamma_0$, for the movement of the air set in motion by the enclosure including the loudspeaker 14.

Thus, when $\gamma_0$, is the acceleration to be reproduced for the diaphragm of the loudspeaker 14, the reference property $A_{ref}$ is the acceleration to be reproduced for the diaphragm of the loudspeaker 14 so that the operation of the loudspeaker 14 imposes an acceleration $\gamma_0$ on the air.

For example, in the case of a closed enclosure in which the loudspeaker 14 is mounted in a closed housing, the desired reference acceleration for the diaphragm $A_{ref}$ is equal to the desired acceleration $\gamma_0$ for the air.

In the case of a vented enclosure in which the loudspeaker is mounted, the desired reference acceleration for the diaphragm $A_{ref}$ is, for example, obtained via the following relationship:

$$A_{ref} = \gamma_D = \gamma_0 + \frac{K_{m2}}{R_{m2}} v_0 + \frac{K_{m2}}{M_{m2}} x_0$$

With:

$R_{m2}$: acoustic leakage coefficient of the enclosure;

$M_{m2}$: inductance equivalent to the mass of air in the vent;

$K_{m2}$: stiffness of the air in the enclosure;

$x_0$: position of the total air displaced by the diaphragm and the vent;

$$v_0 = \frac{dx_0}{dt}:$$

speed of the total air displaced by the diaphragm and the vent;

$$\gamma_0 = \frac{dv_0}{dt}:$$

acceleration of the total displaced air.

In this case, the reference acceleration desired for the diaphragm $A_{ref}$ is corrected for structural dynamic values $x_o$, $v_o$ of the enclosure, the latter being different from the dynamic values relative to the loudspeaker diaphragm.

In the case of an enclosure including a passive radiator formed by a diaphragm, the reference acceleration of the diaphragm $A_{ref}$ is for example given by:

$$A_{ref} = \gamma_0 + \frac{K_{m2}}{R_{m2}} v_0 + \frac{K_{m2}}{M_{m2}} x_{0R}$$

With:

$x_{OR}$ given by filtering by a high-pass filter of $x_0$:

$$x_{0R} = \frac{s^2}{s^2 + \frac{R_{m3}}{M_{m2}} s + \frac{K_{m3}}{M_{m2}}} x_0$$

$K_{m3}$ the mechanical stiffness constant of the diaphragm of the passive radiator.

$R_{m3}$ the mechanical loss resistance of the diaphragm of the passive radiator.

Optionally, the determining unit 34 is capable of filtering the frequencies of the desired dynamic signal $S_{dyn}$ that are strictly below a frequency $f_{min}$ in order to limit the reproduction of the excessively low frequencies. The filtering is, for example, done with one or several successive high-pass filters.

The duplication unit 36 is configured to duplicate, at each moment, the desired dynamic signal $S_{dyn}$ in order to obtain two identical desired dynamic signals $S_{dyn1}$ and $S_{dyn2}$.

The first processing unit 38 is configured to process, at each moment, the first desired dynamic signal $S_{dyn1}$ to obtain a first processed signal $S_{dyn1}'$ whereof the frequencies are less than or equal to a predetermined frequency.

The predetermined frequency is for example comprised in a frequency interval centered on the resonance frequency of the loudspeaker 14 and extending over no more than 200 Hz. The resonance frequency of the loudspeaker 14 is defined as being the resonance frequency of the diaphragm of the loudspeaker 14.

For example, the predetermine frequency is less than or equal to 200 Hz.

Figure 3:
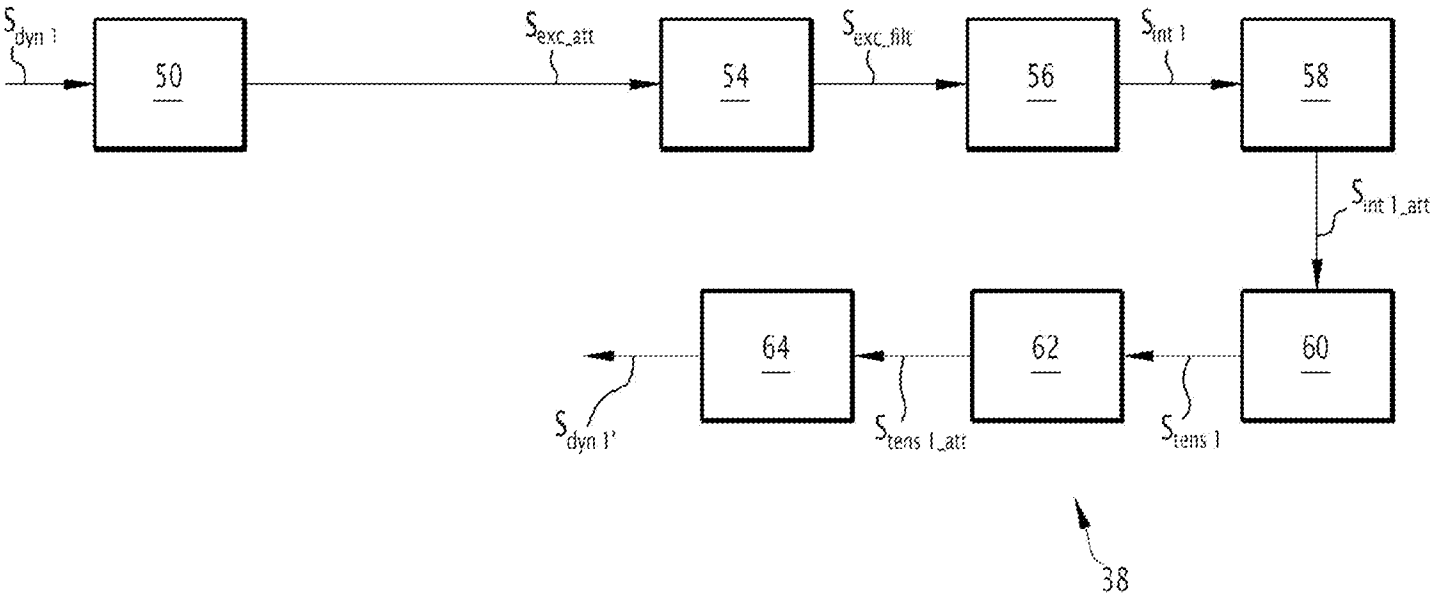
FIG. 3 is a schematic view of a first processing unit of the control device of FIG. 2.

In the example illustrated by FIG. 3, the first processing unit 38 comprises, arranged successively in series, an excursion limiter 50, a filtering module 54, a first determining module 56, a current limiter 58, a second determining module 60, a voltage limiter 62, and optionally, an additional filtering unit 64.

The excursion limiter 50 forms the input of the first processing unit 38 and is configured to receive the desired first dynamic signal $S_{dyn}$. The excursion limiter 50 is configured to determine, at each moment, an excursion signal $S_{exc}$, representative of the excursion of the diaphragm of the loudspeaker 14, as a function of the desired first dynamic signal $S_{dyn}$. The excursion of the diaphragm of the loudspeaker 14 is defined as being the distance from the diaphragm at a moment t, relative to its nominal equilibrium position. Typically, when the diaphragm undergoes an excursion exceeding the maximum excursion acceptable by the diaphragm, the loudspeaker 14 is in a nonlinear operating state, which may damage the loudspeaker 14. The maximum acceptable excursion is for example less than or equal to 10 mm.

The excursion limiter 50 is configured to determine the maximum excursion of the excursion signal $S_{exc}$.

When the determined maximum excursion is strictly greater than the acceptable maximum excursion, the excursion limiter 50 is configured to apply a first attenuation gain to the excursion signal $S_{exc}$ to obtain an attenuated excursion signal $S_{exc_att}$.

The filtering module 54 is configured to filter the frequencies of the attenuated excursion signal $S_{exc_att}$ that are strictly higher than the predetermined frequency to obtain a filtered excursion signal $S_{exc_fit}$.

Advantageously, the filtering module 54 makes it possible to keep only the very low (very bass) frequencies, typically below 200 Hz, or even below 100 Hz.

The filtering module 54 is also configured to determine dynamic properties from the attenuated excursion signal $S_{exc_att}$. These intermediate dynamic properties, denoted $G_{ref}$, are for example the excursion of the diaphragm of the loudspeaker 14, the drift of the excursion corresponding to a speed and the second drift of the excursion corresponding to an acceleration.

The first determining module 56 is configured to determine a first intensity signal $S_{int1}$, representative of the intensity of the current suitable for circulating in the coil of the loudspeaker 14, as a function of the filtered excursion signal $S_{exc_fit}$ and an electromechanical model of the loudspeaker 14. More specifically, the intensity of the current is also determined as a function of the intermediate dynamic properties $G_{ref}$.

The electromechanical model of the loudspeaker 14 is for example a table and/or a set of polynomials, stored in a memory of the control device 22. The electromechanical model makes it possible to define electromechanical properties $P_{méca}$ and electrical properties $P_{élec}$ from the filtered excursion signal $S_{exc_filt}$ and more specifically intermediate dynamic properties $G_{ref}$. The electromechanical $P_{méca}$ and electrical $P_{élec}$ parameters are used in the calculation of the first intensity signal $S_{int1}$.

The electromechanical $P_{méca}$ and electrical $P_{élec}$ parameters are, for example, obtained using models described in application FR 3 018 025 A in the case of a closed enclosure and a vented enclosure.

The electromechanical parameters $P_{méca}$ for example comprise the magnetic flux BI captured by the coil produced by the magnetic circuit of the loudspeaker 14, the stiffness of the loudspeaker 14, denoted $K_{mt}$, the viscous mechanical friction of the loudspeaker 14, denoted $R_{mt}$, and the mobile mass of the entire loudspeaker 14, denoted $M_{mt}$.

For example, the model of the mechanical part of the loudspeaker 14 comprises, in a single closed-loop circuit, a voltage generator Bl(x, i).i corresponding to the driving force produced by the current i circulating in the coil of the loudspeaker 14. The magnetic flux Bl(x, i) depends on the position x of the diaphragm as well as the intensity i circulating in the coil.

This model takes into account the viscous mechanical friction $R_{mt}$ corresponding to a resistance in series with a coil corresponding to the overall mobile mass $M_{mt}$, the stiffness corresponding to a capacitor with capacity $C_{mt}$ (x) equal to $1/K_{mt}$ (x). Thus, the stiffness depends on the position x of the diaphragm.

Lastly, the model circuit includes a generator representative of the force resulting from the reluctance of the magnetic circuit denoted $$F_r(x,\ i) \text{ and equal to } \frac{1}{2}i^2\frac{dL_e(x)}{dx}$$

where $L_e$ is the inductance of the coil and depends on the position x of the diaphragm. The variable v represents the speed of the diaphragm.

The electrical parameters $P_{élec}$ comprise the inductance Le of the coil of the loudspeaker 14, the para-inductance L2 of the coil and the iron loss equivalent R2.

For example, the modeling of the electric part of the loudspeaker 14 of a closed enclosure is formed by a closed-loop circuit. It includes a generator for generating electromotive force connected in series to a resistance representative of the resistance Re of the coil of the loudspeaker 14. This resistance is connected in series with an inductance Le (x, i) representative of the inductance of the coil of the loudspeaker 14. This inductance depends on the intensity i circulating in the coil and the position x of the diaphragm.

To account for magnetic losses and inductance variations by Foucault current effect, a parallel circuit RL is mounted in series at the output of the coil. A resistance with value $R_2$(x, i) depending on the position of the diaphragm x and the intensity i circulating in the coil is representative of the iron loss equivalent. Likewise, a coil with inductance $L_2$(x, i) also depending on the position x of the diaphragm and the intensity i circulating in the circuit is representative of the para-inductance of the loudspeaker 14.

Also mounted in series in the model are a voltage generator producing a voltage Bl(x, i).v representative of the counter-electromotive force of the coil moving in the magnetic field produced by the magnet and a second generator producing a voltage $$g(x,\ i)\cdot v \text{ with } g(x,\ i) = i\frac{dL_e(x,\ i)}{dx}$$

representative of the effect of the dynamic variation of the inductance with the position.

In general, it will be noted that, in this model, the flux BI captured by the coil, the stiffness $K_{mt}$ and the inductance of the coil $L_e$ depend on the position x of the diaphragm, the inductance $L_e$ and the flux BI also depend on the current i circulating in the coil.

Preferably, the inductance of the coil $L_e$, the inductance $L_2$ and the term g depend on the intensity i, in addition to depending on the movement x of the diaphragm.

From the models of the mechanical part and the electrical part of the loudspeaker 14, the following equations are defined:

$$u_e = R_e i + L_e(x,\ i)\frac{di}{dt} + R_2(i - i_2) + Bl(x,\ i)v + i\underbrace{\frac{dL_e(x,\ i)}{dx}}_{g(x,i)}v$$

$$L_2\frac{di_2}{dt} = R_2(i - i_2)$$

$$Bl(x,\ i)i = R_{mt}v + M_{mt}\frac{dv}{dt} + K_{mt}(x)x + \frac{1}{2}i^2\frac{dL_e(x,\ i)}{dx}$$

For example, the intensity $i_{ref}$ of the first intensity signal $S_{iref1}$ and the drift $di_{ref}/dt$ of such an intensity satisfy the following two equations:

$$G_1(x_{ref},\ i_{ref})i_{ref} = R_{mt}v_{ref} + M_{mt}A_{ref} + K_{mt}(x_{ref})x_{ref}$$

$$\frac{d}{dt}(G_1(x_{ref},\ i_{ref})i_{ref}) = R_{mt}A_{ref} + M_{mt}dA_{ref}/dt + K_{mt}(x_{ref})v_{ref} \text{ with}$$

$$G_1(x_{ref},\ i_{ref}) = Bl(x_{ref},\ i_{ref}) - \frac{1}{2}i_{ref}\frac{dL_e(x_{ref},\ i_{ref})}{dx}.$$

In a variant, the intensity $i_{ref}$ of the first intensity signal $S_{int1}$ is obtained using one of the embodiments described in application FR 3 018 025 A.

The current limiter 58 is configured to set at a predetermined intensity value, all of the values of the first intensity signal $S_{int1}$ strictly higher than a predetermined intensity value and thus to obtain an attenuated first intensity signal $S_{int1_att}$. This makes it possible to avoid exceeding the acceptable current limit of the amplifier 16. For example, the predetermine frequency is less than or equal to 15 Amperes (A).

The second determining module 60 is configured to determine a first voltage signal $S_{tens1}$, representative of the voltage across the terminals of the loudspeaker 14, as a function of the filtered excursion signal $S_{exc_filt}$, the electromechanical model of the loudspeaker 14 and the attenuated first intensity signal $S_{int1_att}$.

In one exemplary embodiment, the second determining module 60 is capable of estimating R the resistance $R_e$ of the loudspeaker 14 as a function of the intermediate dynamic properties $G_{ref}$, the intensity of the reference current $i_{ref}$ and its drift $di_{ref}/dt$ and, depending on the considered embodiment, the temperature measured on the magnetic circuit of the loudspeaker 14 denoted $T_{m_mesurée}$ or the intensity measured through the coil denoted $I_{_mesurée}$. An example estimate of the resistance $R_e$ is described in application FR 3 018 025 A.

In the same exemplary embodiment, the second determining module 60 is capable of calculating the voltage across the terminals of the loudspeaker 14 as a function of intermediate dynamic properties $G_{ref}$, the reference current $i_{ref}$ and its drift $di_{ref}/dt$, electrical parameters $P_{élec}$ and the resistance $R_e$. To that end, the second determining module 60 implements the following two equations:

$$u_2 + \frac{L_2(x_{ref}, i_{ref})}{R_2(x_{ref}, i_{ref})}\frac{du_2}{dt} = L_2(x_{ref}, i_{ref})\frac{di_{ref}}{dt}$$

$$u_{ref} = R_e i_{ref} + L_e(x_{ref}, i_{ref})\frac{di_{ref}}{dt} + u_2 + Bl(x_{ref}, i_{ref})v_{ref} + \underbrace{i_{ref}\frac{dL_e(x_{ref}, i_{ref})}{dt}}_{g(x_{ref}, i_{ref})}v_{ref}$$

In a variant, the voltage of the first voltage signal $S_{tens1}$ is obtained using one of the embodiments described in application FR 3 018 025 A.

The voltage limiter 62 is configured to set at a predetermined voltage value, all of the values of the first voltage signal $S_{tens1}$ strictly higher than a predetermined voltage value and thus to obtain an attenuated first voltage signal $S_{tens1_att}$.

The predetermined voltage value is for example greater than or equal to 30 Volts (V).

The additional filtering module 64 is configured to filter the frequencies of the first attenuated voltage signal $S_{tens1_att}$ that are strictly higher than the predetermined frequency. This makes it possible to remove any noise contributed by the current limiter 58 and the voltage limiter 62.

Optionally, the additional filtering module 64 is also configured to filter all of the frequencies that are below or equal to a frequency called low frequency, for example equal to the frequency $f_{min}$ previously defined. This again makes it possible to eliminate any noises resulting from the different processing operations done on the signal during the passage in the different limiters and modules of the first processing unit 38.

The output of the additional filtering module 64 is the first processed signal $S_{dyn1}'$.

In a variant, when the first processing unit 38 does not comprise an additional filtering module 64, the first processed signal $S_{dyn1}'$ is the first attenuated voltage signal $S_{tens1_att}$.

Figure 4:
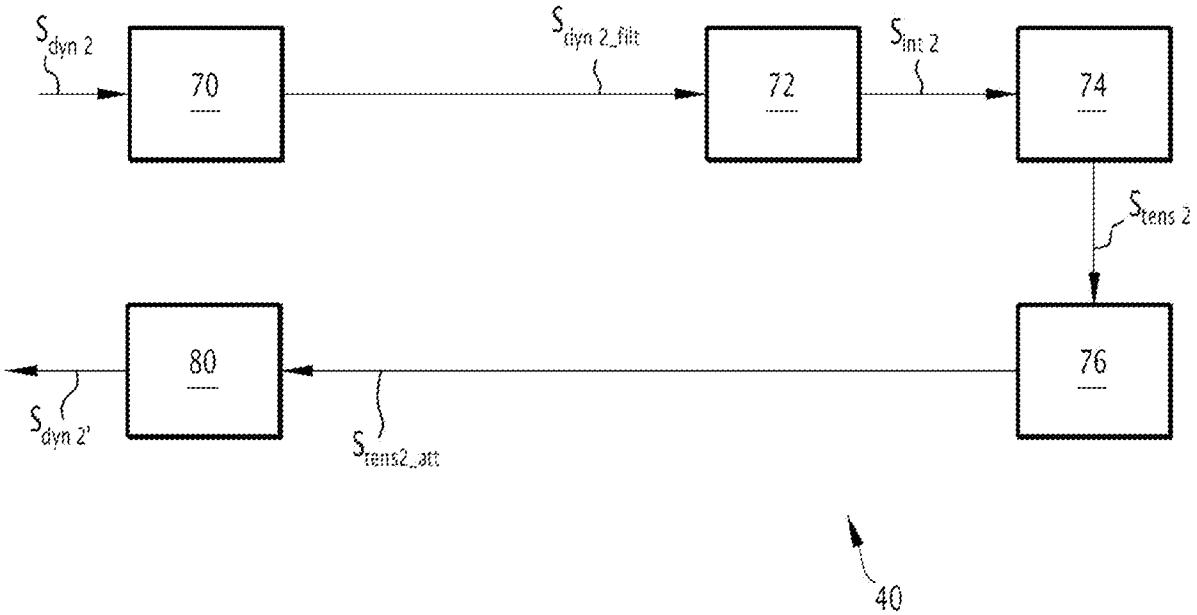
FIG. 4 is a schematic view of a second processing unit of the control device of FIG. 2.

An exemplary second processing unit 40 is illustrated by FIG. 4.

The second processing unit 40 is configured to process, at each moment, the second desired dynamic signal $S_{dyn2}$ to obtain a second processed signal $S_{dyn2}'$ whereof the frequencies are strictly greater than the predetermined frequency.

The second processing unit 40 comprises a filtering module 70, a first determining module 72, a second determining module 74, a voltage limiter 76, and optionally, an additional filtering module 80.

The filtering module 70 is configured to filter the frequencies of the second desired dynamic signal $S_{dyn2}$ lower than or equal to the predetermined frequency in order to obtain a second filtered signal $S_{dyn2_filt}$.

Advantageously, the filtering module 70 makes it possible to keep only the medium bass frequencies, typically above 100 Hz, or even above 200 Hz.

The filtering module 70 is also configured to determine intermediate dynamic properties as a function of the second desired dynamic signal $S_{dyn2}$. These intermediate dynamic properties, denoted $G_{ref}$, are for example the excursion of the diaphragm of the loudspeaker 14, the drift of the excursion corresponding to a speed and the second drift of the excursion corresponding to an acceleration.

The first determining module 72 is configured to determine a second intensity signal $S_{int2}$, representative of the intensity of the current suitable for circulating in the coil of the loudspeaker 14, as a function of the second filtered excursion signal $S_{dyn2_filt}$ and an electromechanical model of the loudspeaker 14. The electromechanical model of the loudspeaker 14 is for example identical to the electromechanical model used for the first processing unit 38.

For example, the first determining module 72 of the second processing unit 40 operates identically to the first determining module 56 of the first processing unit 38.

The second determining module 74 is configured to determine a second voltage signal $S_{tens2}$, representative of the voltage of the loudspeaker 14, as a function of the second filtered signal $S_{dyn2_filt}$, the second intensity signal $S_{int2}$ and the electromechanical model of the loudspeaker 14.

For example, the second determining module 74 of the second processing unit 40 operates identically to the second determining module 60 of the first processing unit 38.

The voltage limiter 76 is configured to determine the maximum voltage of the second voltage signal $S_{tens2}$.

When the determined maximum voltage is strictly greater than an acceptable maximum voltage, the voltage limiter 76 is configured to apply a second attenuation gain to the second voltage signal $S_{tens2}$ to obtain a second attenuated voltage signal $S_{tens2_att}$. The maximum acceptable voltage is for example identical to the predetermined voltage value of the voltage limiter 62 of the first processing unit 38. The second attenuation gain is advantageously different from the first attenuation gain.

In a variant or additionally, the voltage limiter 76 is configured to set at a predetermined voltage value, all of the values of the second voltage signal $S_{tens2}$ higher than the predetermined voltage value and thus to obtain the attenuated second voltage signal $S_{tens2_att}$.

The additional filtering module 80 is configured to filter the frequencies of the attenuated voltage signal that are less than or equal to the predetermined frequency. This makes it possible to remove any noises contributed by the voltage limiter 76 and the modules of the second processing unit 40.

The output of the additional filtering module 80 is the second processed signal $S_{dyn2}'$. In a variant, when the second processing unit 40 does not comprise an additional filtering module 80, the second processed signal $S_{dyn2}'$ is the second attenuated voltage signal $S_{tens2_att}$.

The combining unit 42 is configured to perform, at each moment, the linear combination of the first and second processed signals $S_{dyn2}'$ to obtain the control signal $S_{commande}$ of the loudspeaker 14.

Advantageously, the coefficients of the linear combination are all equal to one such that the combining unit 42 performs the sum of the first and second processed signals $S_{dyn2}'$ in order to obtain the control signal $S_{commande}$ of the loudspeaker 14.

An exemplary operation of the control device 22 will now be described.

Initially, the control device 22 receives, as input, the audio signal $S_{audio_ref}$ to be reproduced.

The determining unit 34 of the control device 22 determines, at each moment, the desired dynamic signal $S_{dyn}$, representative of a desired dynamic property $A_{ref}$ of the diaphragm of the loudspeaker 14, as a function of the audio signal $S_{audio_ref}$ to be reproduced and the structure of the enclosure.

Optionally, the determining unit 34 filters the frequencies of the desired dynamic signal $S_{dyn}$ that are strictly below the frequency $f_{min}$ in order to limit the reproduction of the excessively low frequencies.

The duplication unit 36 next duplicates the desired dynamic signal $S_{dyn}$ in order to obtain two identical desired dynamic signals $S_{dyn1}$ and $S_{dyn2}$.

The first processing unit 38 processes the first desired dynamic signal $S_{dyn1}$ to obtain a first processed signal $S_{dyn1}'$ whereof the frequencies are less than or equal to a predetermined frequency.

To that end, the excursion limiter 50 determines, at each moment, an excursion signal $S_{exc}$, representative of the excursion of the diaphragm of the loudspeaker 14, as a function of the desired first dynamic signal $S_{dyn1}$. Then, the excursion limiter 50 determines the maximum excursion of the excursion signal. When the determined maximum excursion is strictly greater than an acceptable maximum excursion, the excursion limiter 50 applies a first attenuation gain to the excursion signal $S_{exc}$ to obtain an attenuated excursion signal $S_{exc_att}$.

The filtering module 54 next filters the frequencies of the attenuated excursion signal $S_{exc_att}$ that are strictly higher than the predetermined frequency to obtain a filtered excursion signal $S_{exc_filt}$.

Then, the first determining module 56 determines a first intensity signal $S_{int1}$, representative of the intensity of the current suitable for circulating in the coil of the loudspeaker 14, as a function of the filtered excursion signal $S_{exc_filt}$ and the electromechanical model of the loudspeaker 14.

The current limiter 58 next sets a predetermined intensity value, all of the values of the first intensity signal $S_{int1}$ strictly higher than a predetermined intensity value in order to obtain an attenuated first intensity signal $S_{int1_att}$.

The second determining module 60 next determines a first voltage signal $S_{tens1}$, representative of the voltage across the terminals of the loudspeaker 14, as a function of the filtered excursion signal $S_{exc_filt}$, the electromechanical model of the loudspeaker 14 and the attenuated first intensity signal $S_{int1_att}$.

The voltage limiter 62 next sets a predetermined voltage value, all of the values of the first voltage signal $S_{tens1}$ strictly higher than a predetermined voltage value in order to obtain an attenuated first voltage signal $S_{tens1_att}$.

Optionally, the additional filtering module 64 filters the frequencies of the first attenuated voltage signal $S_{tens1_att}$ that are strictly higher than the predetermined frequency. Optionally, the additional filtering module 64 filters all of the frequencies that are below or equal to a frequency called low frequency. The output of the additional filtering module 64 is the first processed signal $S_{dyn}'$.

In parallel with the first processing unit 38, the second processing unit 40 processes, at each moment, the second desired dynamic signal $S_{dyn2}$ to obtain a second processed signal $S_{dyn2}'$ whereof the frequencies are strictly greater than the predetermined frequency.

To that end, the filtering module 70 filters the frequencies of the second desired dynamic signal $S_{dyn2}$ lower than or equal to the predetermined frequency in order to obtain a second filtered signal $S_{dyn2_filt}$.

The first determining module 72 next determines a second intensity signal $S_{int2}$, representative of the intensity of the current suitable for circulating in the coil of the loudspeaker 14, as a function of the second filtered excursion signal $S_{dyn2_filt}$ and the electromechanical model of the loudspeaker 14.

The second determining module 74 next determines a second voltage signal $S_{tens2}$, representative of the voltage of the loudspeaker 14, as a function of the second filtered signal $S_{dyn2_filt}$, the second intensity signal $S_{int2}$ and the electromechanical model of the loudspeaker 14.

Then, the voltage limiter 76 determines the maximum voltage of the second voltage signal $S_{tens2}$. When the determined maximum voltage is strictly greater than the acceptable maximum voltage, the voltage limiter 76 applies a second attenuation gain to the second voltage signal $S_{tens2}$ to obtain a second attenuated voltage signal $S_{tens2_att}$.

The additional filtering module 80 filters the frequencies of the attenuated voltage signal that are less than or equal to the predetermined frequency in order to obtain the second processed signal $S_{dyn2}'$.

Lastly, the combining unit 42 performs the linear combination of the first and second processed signals $S_{dyn1}'$ and $S_{dyn2}'$ to obtain the control signal $S_{commande}$ of the loudspeaker 14.

Thus, the control device 22 makes it possible to perform a different processing operation on two separate frequency bands of an input signal. This is of particular interest for the processing of low (bass) frequencies of a loudspeaker. Indeed, one of the limiting factors for very low frequencies (for example, below 150 Hz) is the excursion of the diaphragm of the loudspeaker 14, as well as the voltage sent to the loudspeaker 14. Therefore, the control device 22 makes it possible to apply a specific treatment on the very low frequencies of the signal in order to limit, on the one hand, the excursion of the membrane above a predetermined value, and to limit, on the other hand, the voltage sent to the loudspeaker 14. On the contrary, for the intermediate low frequencies (for example, bass above 150 Hz), the excursion limitation is optional. Conversely, the limiting factor is the voltage that is applied to the loudspeaker 14, resulting in the addition of a specific treatment for such intermediate frequencies.

Thus, the control device 22 makes it possible to optimize the reproduction of low frequencies, in light of the various constraints of the system (excursion, voltage), in particular for bass loudspeakers with an extended frequency (typically greater than 200 Hz).

The control device 22 therefore makes it possible to reduce the distortion in the signal reproduced by the loudspeaker 14 while improving the protection of the diaphragm of the loudspeaker 14. This makes it possible to improve the reproduction of the signal by the loudspeaker 14.

One skilled in the art will understand that the described control device 22 is not limited to the examples of FIGS. 2 to 4, or to the specific examples of the description. One variant for example consists of combining one or several of the previously described examples or variants when the combination is compatible.

The invention claimed is:

1. A device for controlling a loudspeaker in an enclosure, the loudspeaker comprising a diaphragm, the enclosure having a structure, the device comprising:

an input for an audio signal to be reproduced, an output for supplying a control signal of the loudspeaker, a unit for determining a desired dynamic signal, representative of a desired dynamic property of the diaphragm of the loudspeaker, as a function of the audio signal to be reproduced and the structure of the enclosure, a unit for duplicating the desired dynamic signal to obtain two identical desired dynamic signals, a first processing unit configured to process the first of said two identical desired dynamic signals to obtain a first processed signal having a frequency less than or equal to a predetermined frequency, a second processing unit configured to process the second of said two identical desired dynamic signals to obtain a second processed signal having a frequency greater than the predetermined frequency, and a unit for combining the processed first and second signals to obtain the control signal of the loudspeaker;

wherein the first processing unit comprises an excursion limiter configured to:

determine an excursion signal, representative of the excursion of the diaphragm of the loudspeaker, as a function of the desired first dynamic signal, determine the maximum excursion of the excursion signal, and when the determined maximum excursion is strictly greater than an acceptable maximum excursion, apply a first attenuation gain to the excursion signal to obtain an attenuated excursion signal, the first processed signal being obtained as a function of the attenuated excursion signal; and wherein the loudspeaker comprises at least one coil, the first processing unit comprising:

a module for filtering frequencies of the attenuated excursion signal strictly higher than the predetermined frequency to obtain a filtered excursion signal, a module for determining a first intensity signal, representative of the intensity of the current suitable for circulating in the coil of the loudspeaker, as a function of the filtered excursion signal and an electromechanical model of the loudspeaker, and a current limiter configured to set at a predetermined intensity value, all of the values of the first intensity signal strictly higher than the predetermined intensity value and thus to obtain an attenuated first intensity signal, the first processed signal being obtained as a function of the attenuated first intensity signal.

2. The device according to claim 1, wherein the first processing unit comprises:

a module for determining a first voltage signal, representative of the voltage across the terminals of the loudspeaker, as a function of dynamic properties obtained by the filtering module from the attenuated excursion signal, the electromechanical model of the loudspeaker and the attenuated first intensity signal, and a voltage limiter configured to set at a predetermined voltage value, all of the values of the first voltage signal strictly higher than the predetermined voltage value and thus to obtain an attenuated first voltage signal, the first processed signal being obtained as a function of the attenuated first voltage signal.

3. The device according to claim 2, wherein the first processing unit comprises an additional filtering module configured to filter the frequencies of the attenuated first voltage signal strictly higher than the predetermined frequency, the processed first signal being obtained as a function of the attenuated first voltage signal filtered by the additional filtering module.

4. The device according to claim 1, wherein the second processing unit comprises:

a module for filtering frequencies of the second desired dynamic signal lower than or equal to the predetermined frequency in order to obtain a second filtered signal, a module for determining a second voltage signal, representative of the voltage across the terminals of the loudspeaker, as a function of the second filtered signal and an electromechanical model of the loudspeaker, the second processed signal being obtained as a function of the second voltage signal.

5. The device according to claim 4, wherein the second processing unit comprises a voltage limiter configured to:

determine the maximum voltage of the second voltage signal, when the determined maximum voltage is strictly greater than an acceptable maximum voltage, apply a second attenuation gain to the second voltage signal to obtain a second attenuated voltage signal, the second processed signal being obtained as a function of the second attenuated voltage signal.

6. The device according to claim 5, wherein the second processing unit comprises an additional filtering module configured to filter the frequencies of the attenuated second voltage signal less than or equal to the predetermined frequency, the processed second signal being obtained as a function of the attenuated second voltage signal filtered by the additional filtering module.

7. The device according to claim 1, wherein the predetermined frequency is comprised in a frequency interval centered on the resonance frequency of the loudspeaker and extending over no more than 200 Hz.

8. A sound reproduction facility comprising a loudspeaker in an enclosure and a device for controlling the loudspeaker according to claim 1.

9. A device for controlling a loudspeaker in an enclosure, the loudspeaker comprising a diaphragm, the enclosure having a structure, the device comprising:

an input for an audio signal to be reproduced, an output for supplying a control signal of the loudspeaker, a unit for determining a desired dynamic signal, representative of a desired dynamic property of the diaphragm of the loudspeaker, as a function of the audio signal to be reproduced and the structure of the enclosure, a unit for duplicating the desired dynamic signal to obtain two identical desired dynamic signals, a first processing unit configured to process the first of said two identical desired dynamic signals to obtain a first processed signal having a frequency less than or equal to a predetermined frequency, a second processing unit configured to process the second of said two identical desired dynamic signals to obtain a second processed signal having a frequency greater than the predetermined frequency, and a unit for combining the processed first and second signals to obtain the control signal of the loudspeaker;

wherein the second processing unit comprises:

a module for filtering frequencies of the second desired dynamic signal lower than or equal to the predetermined frequency in order to obtain a second filtered signal, a module for determining a second voltage signal, representative of the voltage across the terminals of the loudspeaker, as a function of the second filtered signal and an electromechanical model of the loudspeaker, the second processed signal being obtained as a function of the second voltage signal; and wherein the second processing unit comprises a voltage limiter configured to:

determine the maximum voltage of the second voltage signal, when the determined maximum voltage is strictly greater than an acceptable maximum voltage, apply a second attenuation gain to the second voltage signal to obtain a second attenuated voltage signal, the second processed signal being obtained as a function of the second attenuated voltage signal.

10. The device according to claim 9, wherein the second processing unit comprises an additional filtering module configured to filter the frequencies of the attenuated second voltage signal less than or equal to the predetermined frequency, the processed second signal being obtained as a function of the attenuated second voltage signal filtered by the additional filtering module.

* * * * *